US006189576B1

(12) United States Patent
Markward

(10) Patent No.: US 6,189,576 B1
(45) Date of Patent: Feb. 20, 2001

(54) APPARATUS FOR THE CONTROLLED MOVING OF A WARP THREAD

(75) Inventor: Dietmar Markward, Rüti (CH)

(73) Assignee: Sulzer Rueti AG, Rueti (CH)

( * ) Notice: Under 35 U.S.C. 154(b), the term of this patent shall be extended for 0 days.

(21) Appl. No.: 09/444,792

(22) Filed: Nov. 22, 1999

(30) Foreign Application Priority Data

Dec. 9, 1998 (EP) ..... 98811213

(51) Int. Cl.[7] ..... D03C 13/00; D03C 7/00
(52) U.S. Cl. ..... 139/54; 310/12
(58) Field of Search ..... 139/54, 194; 310/12

(56) References Cited

U.S. PATENT DOCUMENTS 4,998,420 * 3/1991 Scavino ..... 139/453
5,827,975 * 10/1998 De Jager et al. ..... 73/828
6,006,795 * 10/1998 Corain et al. ..... 139/453

FOREIGN PATENT DOCUMENTS 2119053 12/1972 (DE) .
2133837 1/1973 (DE) .
0393467A1 10/1990 (EP) .
0467059A1 1/1992 (EP) .
0737764A1 10/1996 (EP) .
0750061A1 12/1996 (EP) .
WO 81/02312 8/1981 (WO) .
WO 96/38608 12/1996 (WO) ..... D03C/11/00

* cited by examiner

*Primary Examiner*—Andy Falik
(74) *Attorney, Agent, or Firm*—Townsend and Townsend and Crew LLP

(57) ABSTRACT

An apparatus moves a warp thread in a controlled manner by a punctuate compulsory guidance between three positions, namely a middle, an upper and a lower position. It comprises a pendulum which is pivotal about an axis and into which an electrical coil is integrated and stationary permanent magnets. The named positions are given by equilibrium positions of the pendulum, with forces which act on the pendulum in these positions being in each case in an equilibrium. The equilibrium positions for the upper or the lower position respectively can be produced by forces between the permanent magnets and the currently carrying coil; the equilibrium position for the middle position is given by the pendulum with a current-less coil.

14 Claims, 3 Drawing Sheets

APPARATUS FOR THE CONTROLLED MOVING OF A WARP THREAD

BACKGROUND OF THE INVENTION

The invention relates to an apparatus for the controlled moving of a warp thread. It also refers to a weaving machine with an apparatus of this kind and to uses of the apparatus.

Leno apparatuses are used for the formation of selvedges: An eyed needle, which guides a warp thread in an eye, and a follower needle form a leno weave in interaction with a weft thread (see e.g. EP-A 0 737 764). The needles are moved by drive units which, in known weaving machines, comprise cable runs, control cams, rollers and levers. These mechanical components are expensive and prone to wear. When operating parameters (among others, heald stroke, shed geometry) are changed, time-consuming adjustments must be made by hand.

It is also known to use linear motors as drive units. An electronic processor, which is already used for the control of the weaving machine, can also be used for the control of the linear motors. In this it is however disadvantageous that control loops with special position sensors are required for the setting of warp thread layers using means which act point-wise—for example eyed needles (cf. WO 96/38608)

SUMMARY OF THE INVENTION

The object of the invention is to provide a further apparatus by means of which warp threads—in particular for the formation of cloth edges—are controlledly movable by means of a punctuate compulsory guidance (i.e. with means acting point-wise) and in which the named disadvantages are absent.

This apparatus, controlled by means of a punctuate compulsory guidance, moves a warp thread between three positions, namely a middle position, an upper position and a lower position. It comprises a pendulum which is pivotal about an axis and into which an electrical coil is integrated as well as stationary permanent magnets. The named positions are given by equilibrium positions of the pendulum, with forces which act on the pendulum in these positions in each case being in equilibrium. The equilibrium positions for the upper and the lower positions respectively can be produced by means of forces between the permanent magnets and the current carrying coil; the equilibrium position for the middle position is given by the pendulum with a current-less coil.

DESCRIPTION OF THE PREFERRED EMBODIMENTS

Figure 1:
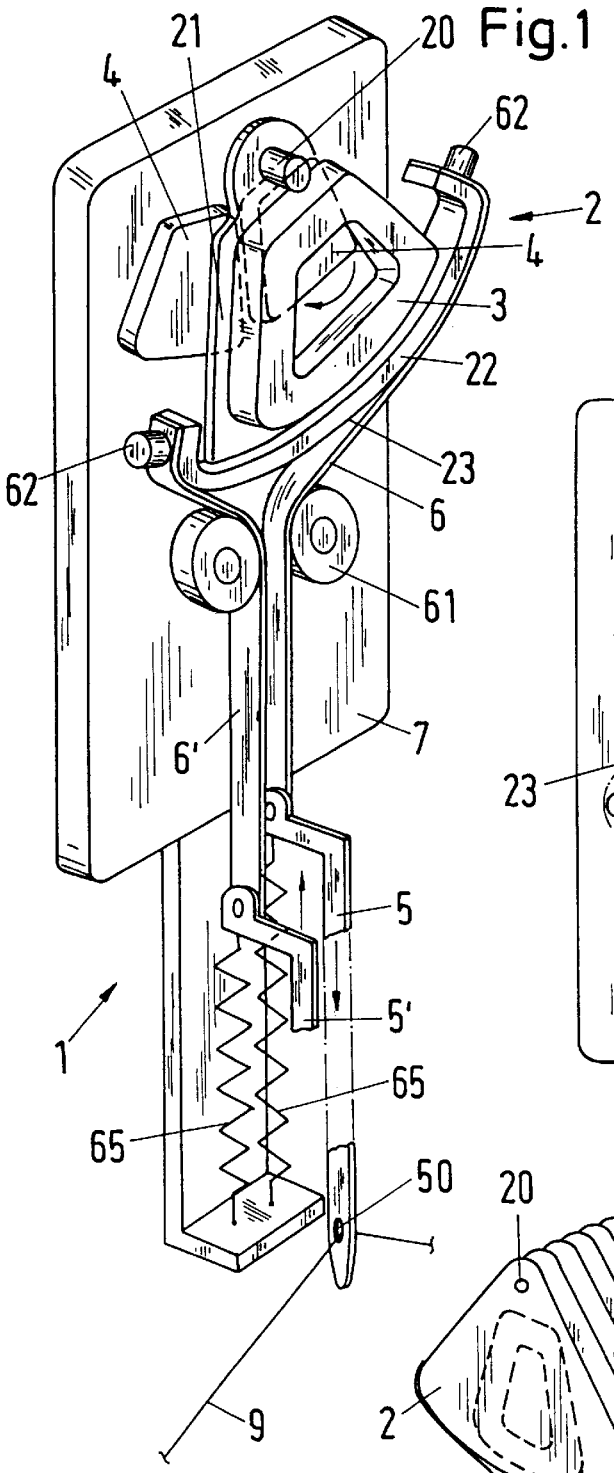
FIG. 1 is a perspective view of an apparatus in accordance with the invention.

FIG. 1 shows an apparatus 1 for the controlled moving of a warp thread 9 which comprises the following components:

a pendulum 2 which is pivotal about an axis 20 into which a coil 3 which is arranged on a non-ferromagnetic sheet metal members 21 or between two such sheet metal member 21 respectively is integrated; permanent magnets 4 on a spatially fixed carrier plate 7; vertically displaceable elements 5 and 5' which are in active contact with a bow 22 of the pendulum 2 via flexible bands 6 and 6'; and springs 65. The bands 6 and 6', which serve as draw means, can also be designed as cables.

A warp thread 9, which is drawn in into an eye 50 of the element 5 and is compulsorily guided by the latter, can be punctuately moved between three positions, namely between a middle, an upper as well as a lower position. These positions are given by equilibrium positions of the pendulum 2 which set in as a result of the forces acting on the pendulum 2. The middle position is given on the one hand by gravitational forces and on the other hand by draw forces of the springs 65. The one coil 3, which carries direct current, produces together with the permanent magnets 4 additional magnetic forces, through which the equilibrium position is displaced to the upper right or left respectively. Through a polarity reversal of the current in the coil 3 the pendulum 2 changes from the one to the other of these two equilibrium positions. The band 6, which can partially lie in contact on the lower side 23 of the bow 22, which is laterally secured with a screw 62 at the pendulum 2 and which is deflected via a roller 61 into the vertical direction, converts the pendulum movement into a linear movement of the element 5. The equilibrium positions of the pendulum 2 are thus transferred to three stable positions of the eye 50, through which the three named positions of the warp thread 9 are given. Sensors are not necessary for a regulation of these positions.

The strip-like or groove-like support surface 23 for the draw means 6 advantageously lies on a curve which is at least approximately a circle about the pendulum axis 20. In particular the pendulum axis 20 can stand on the center of this circle. In this case the stroke of the eye 50, i.e. the distance between its middle and upper (or lower) position, is proportional to the radius of the named circle. The stroke is in addition proportional to the pivotal angle of the pendulum 2, which is determined by the location and shape of the magnets.

The current-less state of the coil 3 and thereby the middle position of the eye 50 is advantageously associated with the shed closure position of a shed which is formed by warp threads 9.

Two elements 5 and 5' for the moving of two warp threads 9 can be provided, with the movement taking place in a counter-similar manner or anti-symmetrical shape: when the coil 3 carries a current the one warp thread 9 is in the upper, the other in the lower position; when the coil 3 is current-less the two warp threads are in the middle position at the same time. When the polarity of the coil 3 is reversed the two warp threads move in opposite directions.

In contrast to linear motors, the weight of the movable part, namely the pendulum 2, does not have to be taken up by electromagnetic forces in the apparatus in accordance with the invention.

Figure 2:
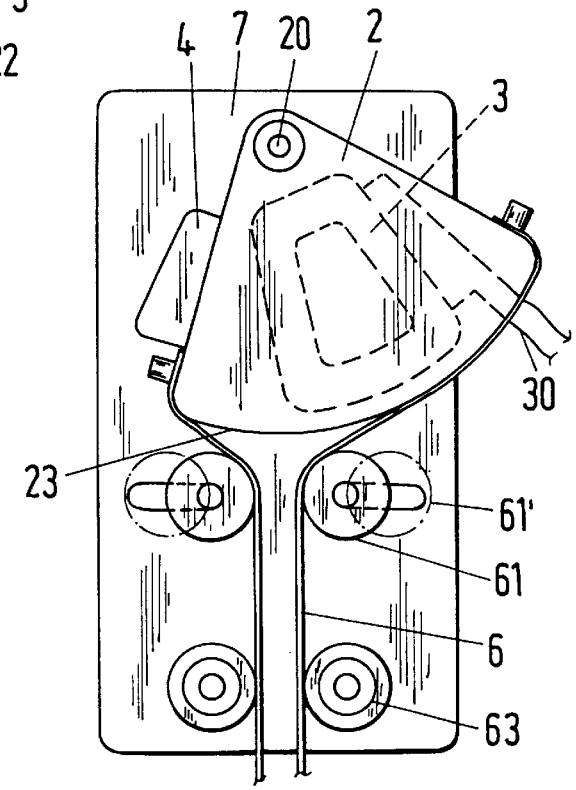
FIG. 2 shows a variant of this apparatus.

In the variant of the apparatus 1 in accordance with the invention shown in FIG. 2 the pendulum 2 is a segment plate of a non-ferromagnetic material in which the coil 3 (with connection wires 30) is embedded. The deflection rollers 61, 61' have horizontally displaceable axes. A second roller pair 63 have axes with fixed positions.

Figure 3:
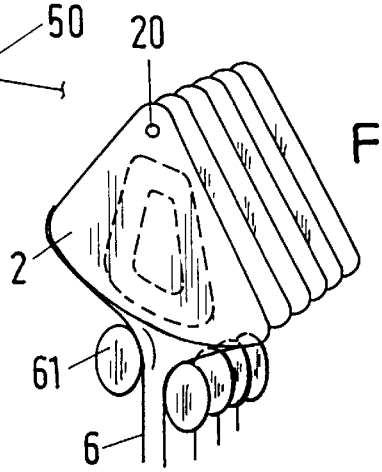
FIG. 3 shows a plurality of apparatuses which are arranged in parallel (for a Jacquard shed forming apparatus)

A plurality of apparatuses in accordance with the invention, by means of which a plurality of warp threads can be moved at the same time, can be space-savingly arranged in parallel, as is schematically illustrated in FIG. 3.

Figure 4:
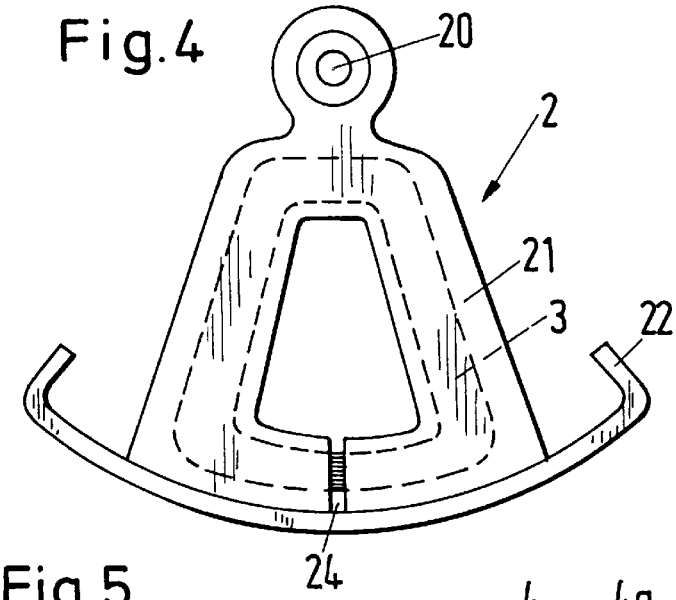
FIGS. 4–6 illustrate details of a further variant of the apparatus in accordance with the invention.
Figure 5:
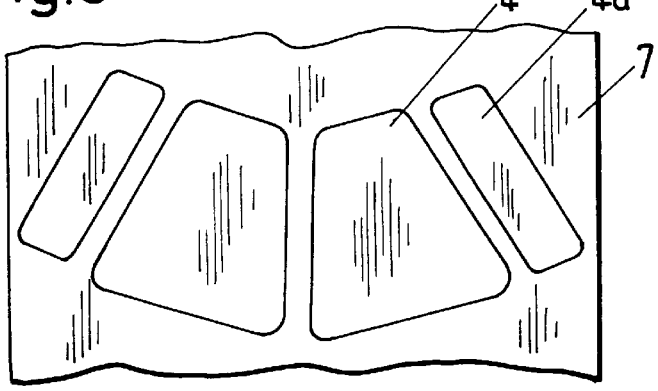
Figure 6:
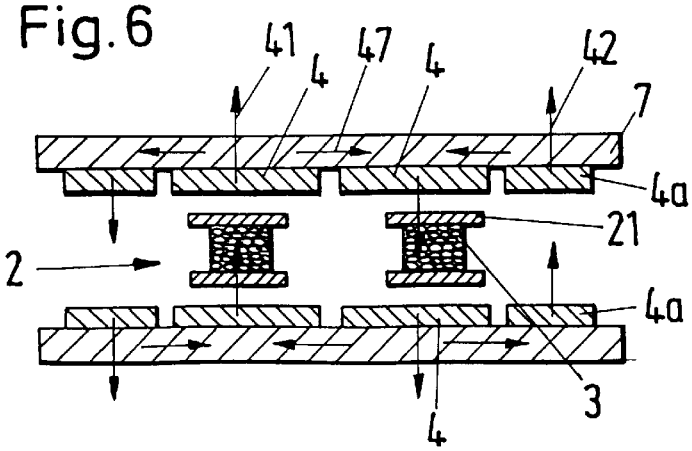

A side view of a pendulum 2, as is contained in the apparatus 1 of FIG. 1, is shown in FIG. 4. A configuration of permanent magnets 4, 4*a* for this pendulum 2 which are arranged on the carrier plate 7 is illustrated in FIG. 5; and a horizontal cross-section through this pendulum 2 is shown in FIG. 6 with the permanent magnets 4, 4*a* which are arranged on both sides.

The electrical coil 3 is designed as a flat ring. The magnetic field which can be produced with the coil 3 is oriented at least approximately parallel to the pendulum axis 20 at the center of the ring. The permanent magnets 4, 4*a* are designed in disc shape and are arranged parallel to the coil 3. The magnetizations of the permanent magnets 4, 4*a* are oriented the same as the named magnetic field of the coil or opposite to the latter respectively. The permanent magnets 4, 4*a* are advantageously arranged on both sides of the pendulum on ferromagnetic carrier plates 7 and form in each case a similar configuration. In FIG. 6 the magnetizations of the permanent magnets 4, 4*a* are given by arrows 41, 42. Arrows 47 represent a magnetization of the ferromagnetic carrier plates 7. The two adjacent permanent magnets 4 and 4*a* are arranged in the reversal region of the pendulum 2; they have magnetizations which are oriented oppositely to one another. The smaller partner 4*a* of this permanent magnet pair serves as a brake magnet for the pendulum 2. With this a situation is achieved in which the pendulum 2 comes to rest rapidly in the upper equilibrium position as a result of a damping action. In addition, the permanent magnet pair 4 and 4*a* ensure a more precise reversal or end position of the pendulum 2.

In order that the transition between the three equilibrium positions can take place without disturbing transient oscillations, the sheet metal laminae 21 are manufactured of a material which is a good electrical conductor but is not ferromagnetic. Aluminum can for example be chosen as a material. Eddy currents which are induced in these sheet metal laminae 21 during the movement of the permanent magnets 4, 4*a* in the magnetic field damp the movement of the pendulum 2. A gap 24 is provided in the sheet metal laminae 21—see FIG. 4—in order that a ring current does not form through induction during the switching on or over of the coil current, which would represent an unnecessary dissipation of energy.

Figure 7:
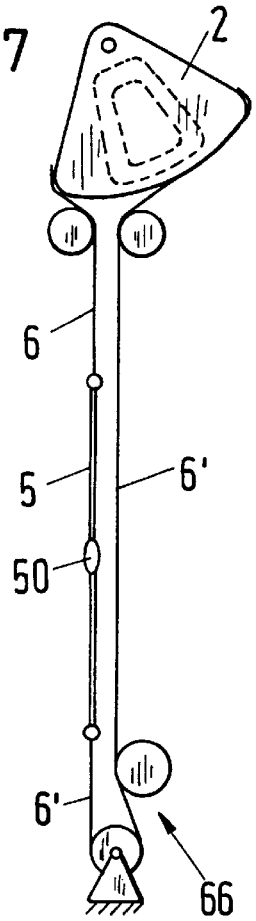
FIGS. 7, 8 illustrate two particular possibilities of connecting displaceable elements to a pendulum of the apparatus in accordance with the invention.
Figure 8:
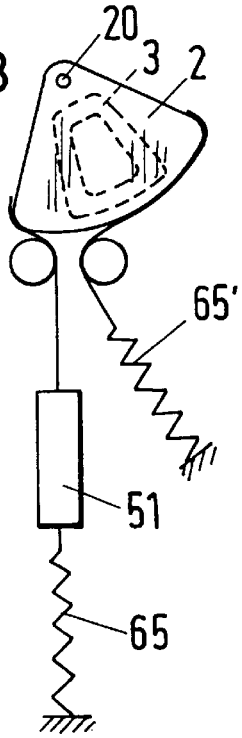

With the apparatus 1 illustrated in FIG. 7*a* heald 5 is controlled which contains the eye 50, and at both ends of which the bands 6, 6' grip on. The band 6' is deflected via rollers by 180°. In the apparatus 1 of FIG. 8 the non-illustrated warp thread (or group of warp threads) is moved with an element 51, the weight of which must be taken into account when setting the middle position. The springs 65 and 65' can be chosen and set in such a manner that when the coil 3 carries no current the pendulum 2 is in an equilibrium position in which for example the center of gravity of the pendulum is located vertically beneath the axis 20.

Figure 9:
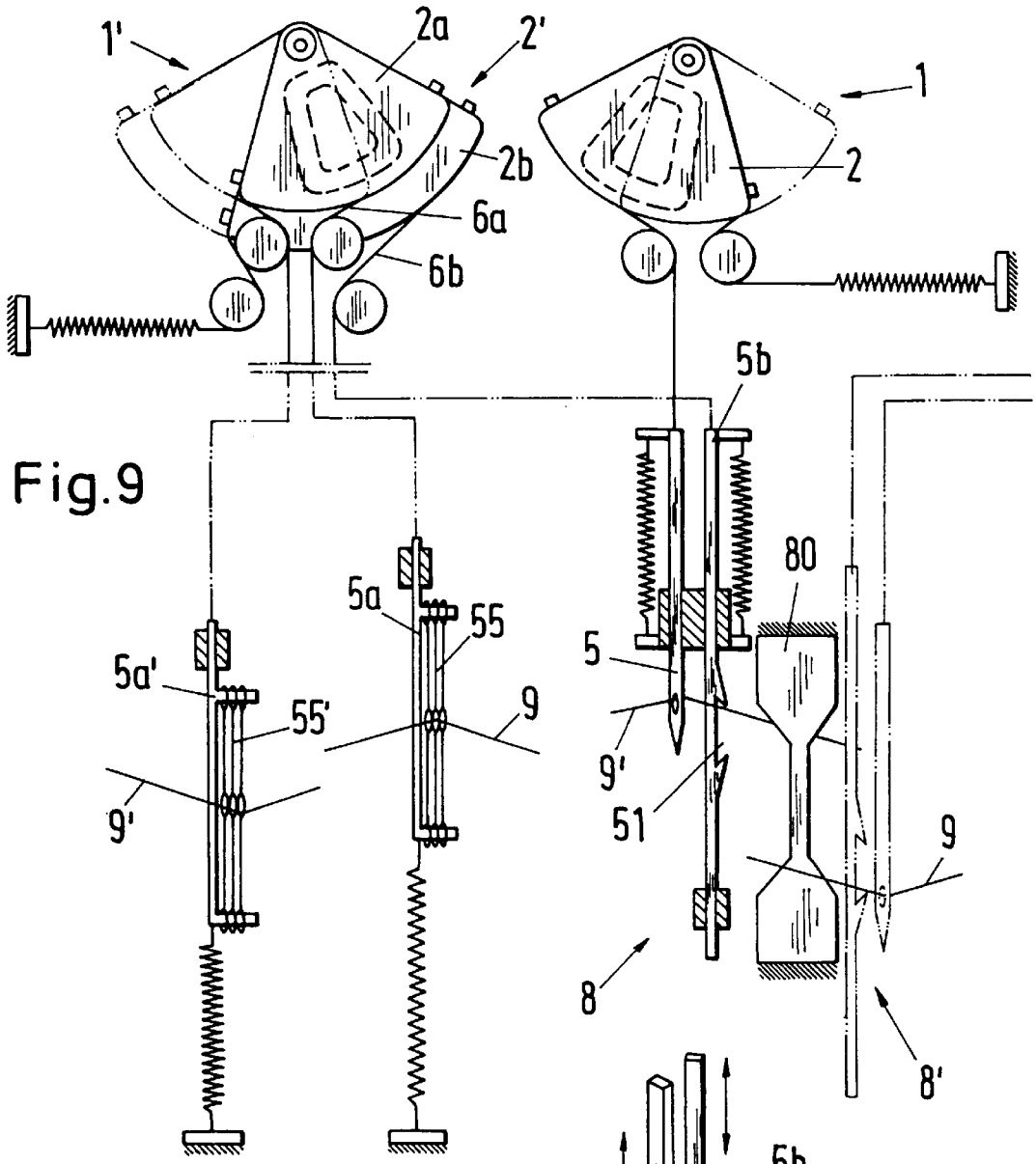
FIG. 9 shows a rotator apparatus.
Figure 10:
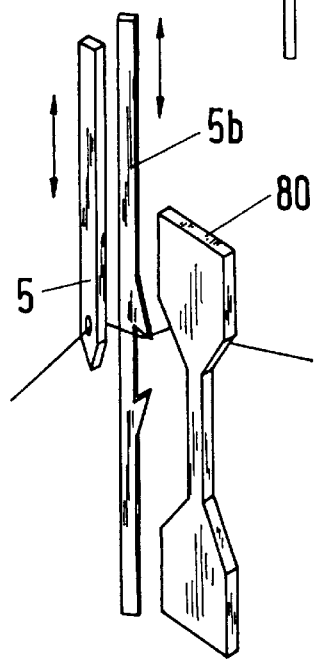
FIG. 10 illustrates a half rotator apparatus in the rotator apparatus of FIG. 9.

FIG. 9 shows the use of apparatuses 1, 1' in accordance with the invention in half rotator apparatuses 8 and 8': By means of a first apparatus 1 the warp thread 9' is moved with an eyed needle 5. A hooked needle 5*b* (with a double hook 51), which cooperates in a known manner with the eyed needle 5, is actuated by a second apparatus 1'. With this second apparatus 1' elements 5*a* and 5*a*, which carry auxiliary edge heald frames 55, 55', are simultaneously moved up and down in a counter-similar manner. The pendulum 2' of the apparatus 1' comprises two segment plates 2*a*, 2*b* with different radii. The hooked needle 5*b* is in connection with the segment plate 2*b* with the larger radius. Accordingly, a greater stroke results than for the auxiliary edge heald frames 55, 55'. Such different strokes are preferred for the production of a leno edge. A plate 80 which is fixed in space—see also the oblique view in FIG. 10—is arranged between the half-cross leno elements 8 and 8'. Required deflections of the warp threads 9, 9*a* result through edges of this plate 80 in a known manner.

An apparatus for the formation of a leno selvedge is also known which comprises two lifter healds, which are to be moved counter-similarly, and a half heald (DE-A 40 00 035). This apparatus can be actuated with only one apparatus in accordance with the invention.

The equilibrium position with current-less coil can be influenced with additional permanent magnets. In this at least one magnet must be arranged on the pendulum: for example in the inner region of the ring-shaped coil (no figure).

In the examples described the warp threads are moved individually. They can also be moved combined together group-wise, such as for example is known for Jacquard shed formation apparatuses. The elements for the moving of warp threads are replaced in this by members by means of which in each case a group of warp threads can be moved at the same time.

Weaving machines can be equipped with a plurality of apparatuses in accordance with the invention. This is particularly advantageous when the weaving machine is operated by means of an electronic and programmable control system. A processor for a control system of this kind can also be used for the control of the apparatuses in accordance with the invention. The currents of the coils can thus be programmed so as to be automatically settable, and indeed in such a manner that they assume values which are correspondingly predetermined for the warp thread types.

What is claimed is:

1. An apparatus for controlled moving of a warp thread by a punctuate compulsory guidance between three positions, namely a middle position, an upper position, and a lower position, the apparatus comprising:

a pendulum which is pivotal about a pendulum axis to move between left and right positions, the pendulum including an electrical coil chargeable with a current, the pendulum configured to be connected with the warp thread; and a pair of stationary permanent magnets disposed adjacent the right position and the left position, respectively, wherein the pendulum is movable between the three positions and is in equilibrium in the three positions by forces between the electrical coil and the stationary permanent magnets, the middle position in equilibrium being produced when the electrical coil is current-less, the upper position in equilibrium being produced when the electrical coil carries a current in one polarity, the lower position in equilibrium being produced when the electrical coil carries a current in an opposite polarity.

2. The apparatus of claim 1 further comprising a displaceable element operatively connected with the pendulum by a flexible band, the displaceable element including an eye or a hook for connecting with the warp thread.

3. The apparatus of claim 2 wherein the pendulum includes a strip-like support surface for the flexible band, the support surface lying on a curve which is at least approximately a circular arc about the pendulum axis.

4. The apparatus of claim 3 wherein the support surface has a groove shape.

5. The apparatus of claim 1 further comprising means for connecting the warp thread with the pendulum.

6. The apparatus of claim 1 further comprising:

a left displaceable element operatively connected with the pendulum by a left flexible band and coupled to a left vertically displaceable member for connecting with a left warp thread; and a right displaceable element operatively connected with the pendulum by a right flexible band and coupled to a right vertically displaceable member for connecting with a right warp thread.

7. The apparatus of claim 6 wherein the left and right warp threads move in an anti-symmetrical manner, with the left warp thread in the upper position and the right warp thread in the lower position when the coil carries a current in one polarity, with the left warp thread in the lower position and the right warp thread in the upper position when the coil carries a current in an opposite polarity, and with the left and right warp threads in the middle position when the coil is current-less.

8. The apparatus of claim 1 further comprising:

a left displaceable element operatively connected with the pendulum by a left flexible band and adapted to be coupled to a left auxiliary edge heald frame for connecting with a group of left warp threads; and a right displaceable element operatively connected with the pendulum by a right flexible band and adapted to be coupled to a right auxiliary edge heald frame for connecting with a group of right warp threads.

9. The apparatus of claim 8 wherein the group of left warp threads and the group of right warp threads move in an anti-symmetrical manner, with the left warp threads in the upper position and the right warp threads in the lower position when the coil carries a current in one polarity, with the left warp threads in the lower position and the right warp threads in the upper position when the coil carries a current in an opposite polarity, and with the left and right warp threads in the middle position when the coil is current-less.

10. The apparatus of claim 1 wherein the electrical coil comprises a flat ring for producing a magnetic field at least approximately parallel to the pendulum axis at the center of the flat ring, wherein the permanent magnets are disc-shaped and arranged parallel to the coil, the permanent magnets having magnetizations oriented in the same or opposite direction to the magnetic field of the coil.

11. The apparatus of claim 1 further comprising a pair of ferromagnetic carrier plates disposed on front and back sides of the pendulum, each ferromagnetic carrier plate having a pair of stationary permanent magnets disposed adjacent the right position and the left position of the pendulum.

12. The apparatus of claim 1 wherein the pendulum comprises at least one non-ferromagnetic sheet metal member on which the coil is mounted and by which a pendulum movement can be damped as a result of eddy current.

13. The apparatus of claim 1 further comprising another pair of stationary permanent magnets to provide a left pair of permanent magnets adjacent the left position of the pendulum and a right pair of stationary permanents adjacent the right position of the pendulum, the left pair of permanent magnets having magnetizations opposite to the magnetizations of the right pair of permanent magnets.

14. A weaving machine comprising:

a plurality of apparatuses each for controlled moving of a warp thread by a punctuate compulsory guidance between three positions, namely a middle position, an upper position, and a lower position, each apparatus comprising:

a pendulum which is pivotal about a pendulum axis to move between left and right positions, the pendulum including an electrical coil chargeable with a current, the pendulum configured to be connected with the warp thread; and a pair of stationary permanent magnets disposed adjacent the right position and the left position, respectively, wherein the pendulum is movable between the three positions and is in equilibrium in the three positions by forces between the electrical coil and the stationary permanent magnets, the middle position in equilibrium being produced when the electrical coil is current-less, the upper position in equilibrium being produced when the electrical coil carries a current in one polarity, the lower position in equilibrium being produced when the electrical coil carries a current in an opposite polarity; and an electronic and programmable control system for actuating the apparatuses, wherein the electrical currents of the coils are settable and predeterminable in accordance with warp thread type.

* * * * *